United States Patent [19]

Beynet et al.

[11] 4,293,146

[45] Oct. 6, 1981

[54] VMP CASING TIEBACK

[75] Inventors: Pierre A. Beynet, Tulsa, Okla.; James E. Lucksinger, Carbondale, Colo.; Martin B. Jansen, Jr., Houston, Tex.

[73] Assignee: Standard Oil Company (Indiana), Chicago, Ill.

[21] Appl. No.; 948,466

[22] Filed: Oct. 4, 1978

[51] Int. Cl.[3] ..... F16L 35/00

[52] U.S. Cl. ..... 285/24; 285/331; 285/347; 285/361

[58] Field of Search ..... 405/202, 208, 224; 285/18, 39, 24, 27, 360, 361, 376, DIG. 23, 401, 402, 396, 347, 331, 95, 107; 403/349, 348, DIG. 7; 166/338, 240; 114/264, 265

[56] References Cited

U.S. PATENT DOCUMENTS

| | | | |
|---|---|---|---|
| 1,083,120 | 12/1913 | May | 285/402 X |
| 1,130,726 | 3/1915 | Greve | 285/376 |
| 1,916,449 | 7/1933 | Tompkins | 285/376 X |
| 2,015,786 | 10/1935 | Carcano | 285/361 X |
| 2,327,503 | 8/1943 | Coberly | 285/361 X |
| 2,698,761 | 1/1955 | Claypool et al. | 285/376 X |
| 3,211,479 | 10/1965 | Brown | 285/360 |
| 3,605,414 | 9/1971 | Westmoreland | 405/208 |
| 3,648,638 | 3/1972 | Blenkarn | 114/265 |

*Primary Examiner*—Dave W. Arola
*Attorney, Agent, or Firm*—John D. Gassett

[57] ABSTRACT

Special J-slot connectors have been devised for connecting concentric riser pipes and casing from a structure at the surface of a body of water to corresponding concentric casings set in the sea floor. This can be called a "tieback tool" for sealingly securing a first tubular member suspended from a vessel floating on a body of water to a casing hung in the wellbore in the bottom of the body of water. Special multiple axially aligned J-slot means are also provided together with means to assure proper "makeup" of the J-slots. Means are also provided for proper alignment of circumferentially spaced J-slot connectors. Special self-emergizing seals are also disclosed.

11 Claims, 9 Drawing Figures

FIG. 1
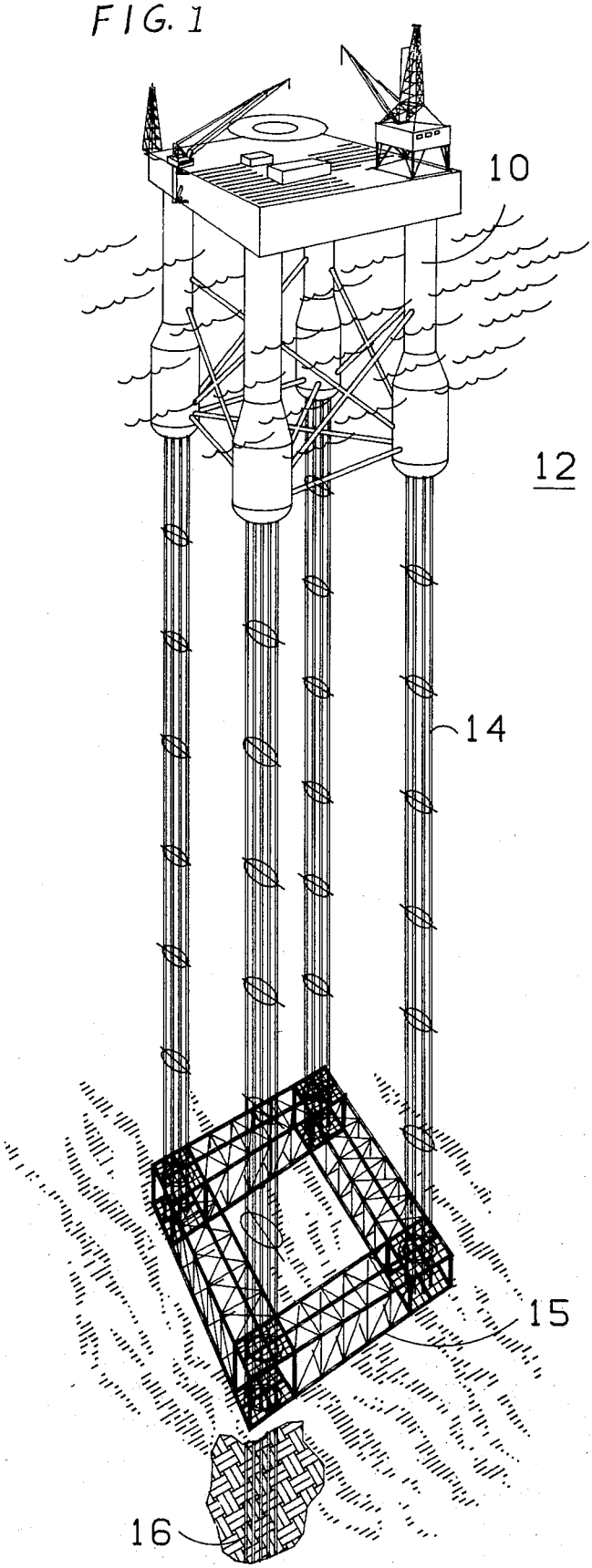
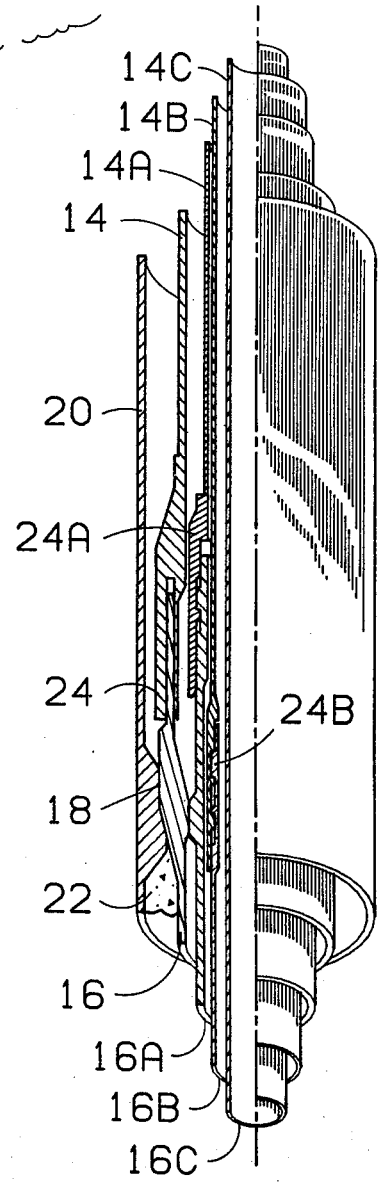
FIG. 2

VMP CASING TIEBACK

BACKGROUND OF THE INVENTION

FIELD OF THE INVENTION

This invention relates primarily to a structure floating on a body of water. More particularly, the invention relates to a tieback tool for sealingly securing a first tubular member or riser pipe suspended from a vessel floating on a body of water to a casing hung in the wellbore in the bottom of the body of water.

SETTING

In recent years, it has become desirable to use a floating vessel from which to drill wells in marine locations. Many of these structures have been maintained on station by conventional spread catenary mooring lines, or by propulsion thruster units. One system of floating vessel receiving attention for drilling or production of wells in water is the Vertically Moored Platform (VMP), such as described in U.S. Pat. No. 3,648,638, issued Mar. 14, 1972, Kenneth A. Blenkarn, inventor. A key feature of Vertically Moored Platforms is that the floating platform is connected to anchor means in the ocean floor only by elongated parallel members which are preferred to be large diameter conduits, commonly called "riser pipes." These elongated members or riser pipes are held in tension by excess buoyancy of the platform. In this system, it is preferred that there be several concentric casing strings set in the ocean floor and cemented in place. Corresponding concentric riser pipes or casing strings will extend from the ocean floor to the floating vessel. This present invention discloses novel means of sealingly connecting the corresponding set casings to the corresponding riser casing strings extending from the mudline suspension system in the set casings to the floating vessel.

CROSS-REFERENCE

U.S. patent application Ser. No. 899,608, filed Apr. 24, 1978, entitled "Vertically Moored Platform Anchoring," describes an anchoring system utilizing concentric casing strings set in the ocean floor which are connected to concentric casing strings within the riser pipe extending from the set casings to the floating vessel.

PRIOR ART

In the past, riser pipes have been connected to the casing by mechanical connectors. To our knowledge, none of these systems teach the particular J-slot connections and sealing means which we describe and claim. J-slots for lowering and recovering equipment is well known. For example, see U.S. Pat. No. 3,605,414, which is apparently one of these situations.

BRIEF DESCRIPTION OF THE INVENTION

This concerns a tieback tool for sealingly securing a first tubular member (e.g., riser pipe) suspended from a vessel floating on a body of water to a casing hung in a wellbore and preferably cemented in the bottom of the body of water. There is provided a male tubular member having a J-slot on its exterior and the neck having a wall thickness $t_1$. There is also provided a female tubular member adapted to fit over the male tubular member and having a lug on the interior thereof. The female tubular member has a neck section having a wall thickness of $t_2$. In a preferred embodiment, the wall thickness $t_2$ is greater than $t_1$ and the neck having a thickness $t_1$ has substantially greater radial expansion under a given internal pressure. A seal is provided between the neck of the male tubular member and the section or neck of the said female tubular member and is energized by the greater radial expansion of the neck of the male member.

In another embodiment, multi-J-slot connectors are spaced longitudinally along the wall of the connecting tubular members. There are two longitudinal slots, for example, and two mating longitudinally spaced J-lugs. Special orienting means is provided so that each lug fits in its proper J-slot. Special construction means are also taught for aligning the radially spaced J-slots.

Various objects and a better understanding of the invention can be had from the following description taken in conjunction with the drawings.

DESCRIPTION OF THE DRAWINGS

FIG. 1 is schematic view of a Vertically Moored Platform having a riser pipes extending from the ocean floor to the floating structure;

FIG. 2 illustrates schematically the connection between the concentric casing strings set in the bottom of the body of water and the mating concentric tubular strings extending to the floating structure;

DETAILED DESCRIPTION

Figure 3:
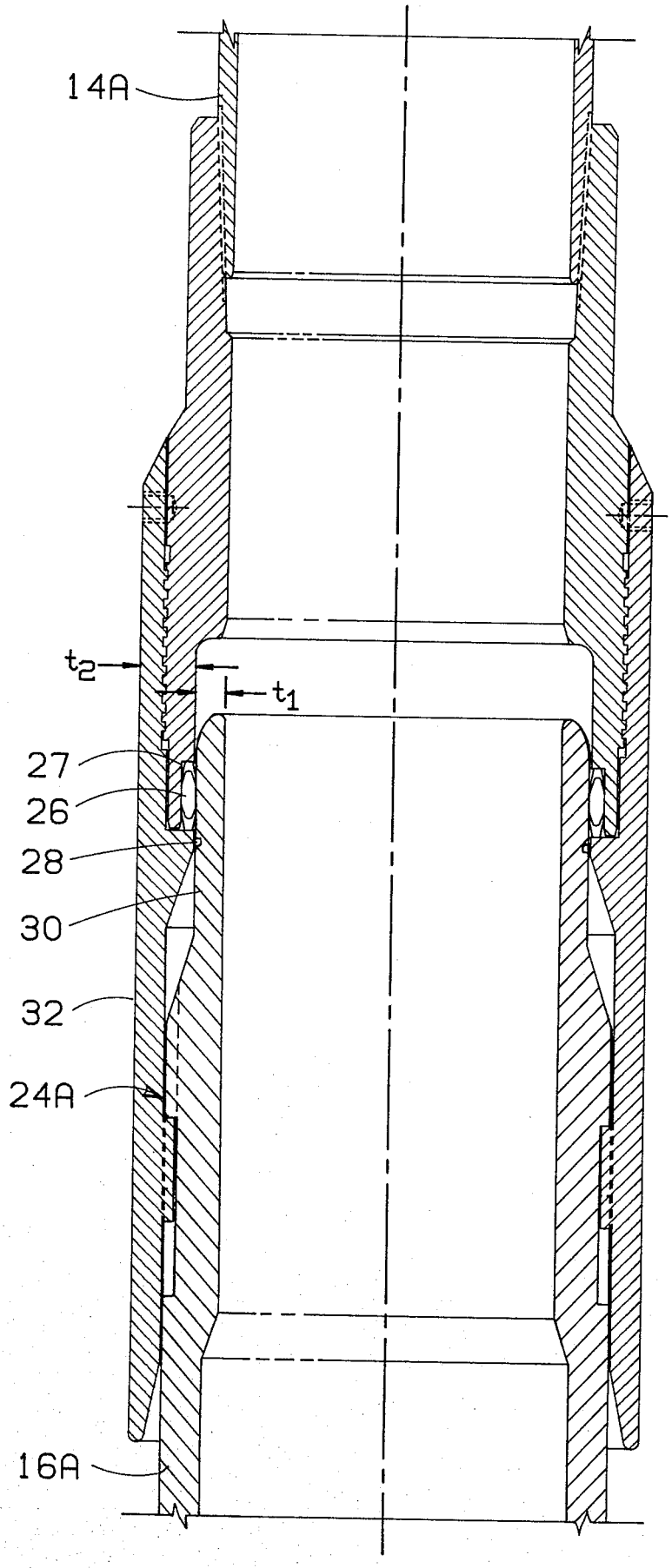
FIG. 3 is a vertical section through an assembly having a J-slot connector with self-energizing seal.

Reference is first made to FIG. 1 which shows an isometric view of a Vertically Moored Platform (VMP) which comprises a floating structure 10 floating on a body of water 12 and connected by vertical riser pipes 14 to casing 16 indicated as being anchored in the soil. Ordinarily, a sufficient number of casing 16 will be set in place in the holes in the ocean bottom and anchored there such as by cementing in order to form a firm anchor. Next, the floating structure such as a VMP will be connected to casing 16 by vertical riser pipes 14. The vertical riser pipes 14 may be anywhere from as little as 600 feet or less to 5000 feet or more in length. In this concept of using riser 14 to drill through, it is necessary to form a seal-tight connection between the riser pipes 14 and the set casing 16. This invention discloses such a sealing connector. It is also pointed out that each casing 16 in reality has a plurality of concentric casing strings suspended therein; accordingly, the riser pipe indicated as 14 will normally have a plurality of inner concentric casings which are connected to the inner casings hung within casing 16.

FIG. 2 illustrates schematically various concentric casing strings 16, 16A, 16B, and 16C, which are connected to riser pipe 14 and its inner strings of casings 14A, 14B, and 14C. Outer casing string 16 is hung off at 18 from drive pipe 20. Casing string 16 is cemented in below the mudline landing 18. A J-slot connector 24 connects casing 16 to riser pipe 14. Inner J-slot connectors 24A and 24B likewise connect casing strings 16A and 16B to casing strings 14A and 14B. Inner string 14C is shown as being continuous but it normally would also be hung off in a manner similar to that for casing string 16A. Drive pipe 20 is supported from template 15. Details of these J-slot connectors will be described in connection with the remainder of the drawings.

FIG. 3 illustrates in cross-sectional form the J-slot connection 24A which connects a lower casing 16A (set and cemented in the sea bed) and an upper casing string 14A which extends to the floating vessel. A neck 30 on the male tubular member extends above J-slot 24A on casing 16A. This has a wall thickness $t_1$. Fitting down over neck 30 is upper casing extension 32 of the female tubular member. An O-ring seal 28 fits between neck 30 and extension 32. In extension 32 there is provided a cavity 27 which contains seal 26. At this level, the neck 30 has a wall thickness $t_1$ and the extension 32 has a wall thickness $t_2$. $t_2$ is made greater than $t_1$; thus, if the two elements are made of comparable material, the inner member 30 will have a greater radial expansion than would outer member 32. For a given internal pressure, then, this results in an uneven tendency to expand, with the inner member 30 having a greater tendency to expand, thus aiding and effecting the self-energizing seal 26. The placement of the seal near the end of the male member does increase the difference in radial flexibility and thus does increase the autosealing effect.

Figure 4:
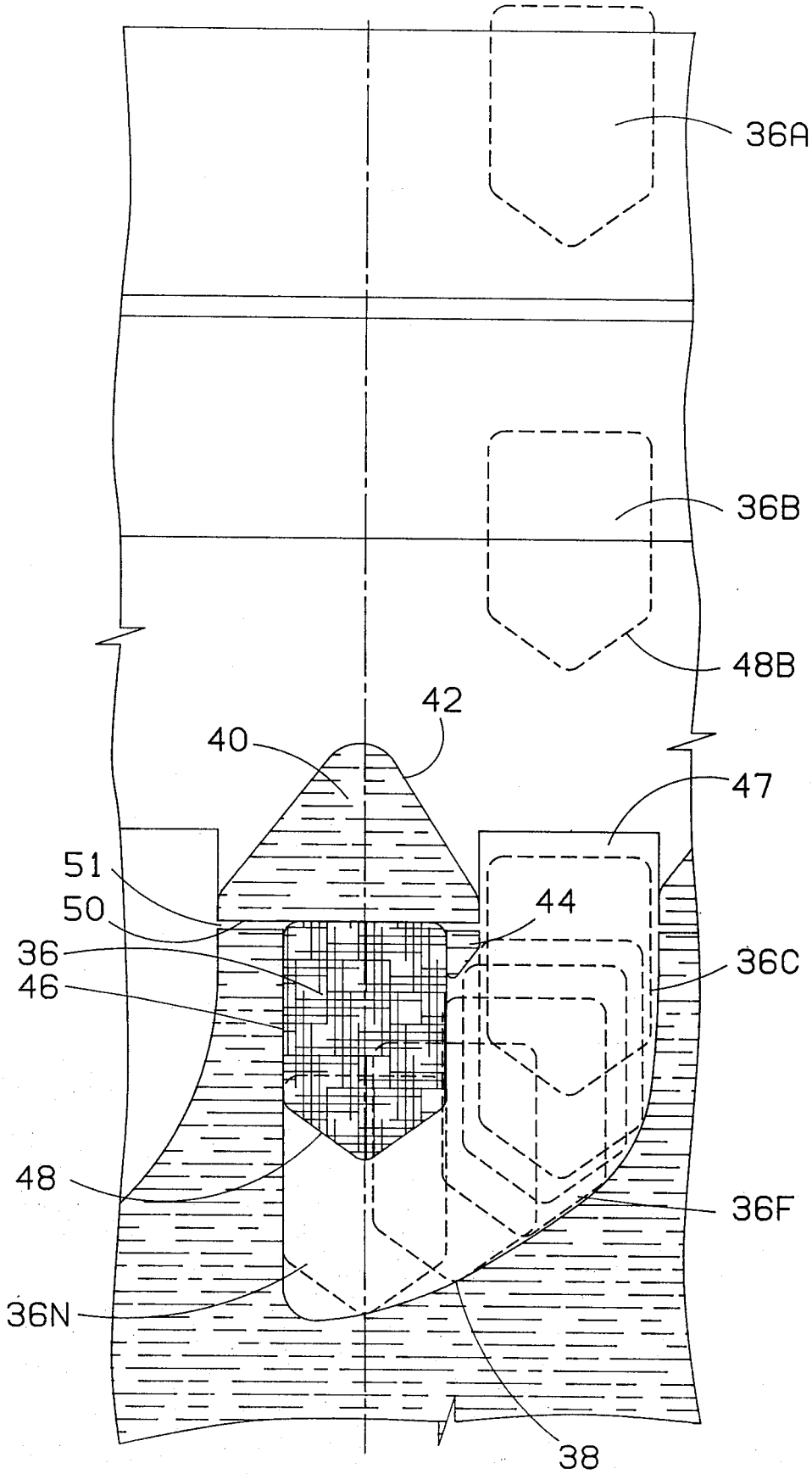
FIG. 4 illustrates the special J-slot arrangement used in the device of FIG. 3.

Attention is next directed to FIG. 4 which illustrates the preferred embodiment of the J-slot. Shown thereon is a lug 36 positioned in locking J-slot 46. It is to be noted that this is a view of the inside of the tubular members being connected and that this configuration of FIG. 4 takes up slightly over 25 percent of the circumferential view. In other words, there are four lugs 36 and locking slots 46 spaced circumferentially on the same elevation. (There could be any number but four is the normally preferred number.) Load-bearing surface 50 is the lower side of indexing and load-bearing plateau 40 which is wedge-like in shape and has an indexing race 42. Lug 36 has a stabbing surface 48. Various advancing positions of lug 36 are shown starting with 36A which is considerably above the indexing and load-bearing plateau 40. As lug 36 is lowered, it may assume the position 36A and, if not aligned with passage or throat 47 leading to the J-slot, the stabbing surface 48B will contact indexing race 42 and cause the lug to be rotated as it is lowered until it is aligned with passage 47. The lug 36 will then assume the various positions indicated by the dotted lines until it reaches a position 36N. When lug 36 reaches an intermediate position 36F, at least a portion of the bearing surface 46B contacts guiding race 38. This causes the lug and the pipe on which it is connected to be turned by the weight of the string of pipe supporting the lug 36. This continues until lug 36 reaches the position 36N. The upper pipe 14A which supports lug 36 is then lifted until lug 36 is forced against load-bearing surface 50. As a precautionary measure when upward force is applied to casing string 14A, a light torque is also applied to the string so that there is no chance that lug 36 will slip out of its alignment directly beneath the load-bearing surface 50 and within locking slot 46. Indexing plateau 44 aids in maintaining lug 36 in its proper position. The "sharp corners" shown in the drawings would, in construction, be rounded or shaped to reduce concentration of stresses.

A preferred guiding race 38 has two requirements: (1) it must be deep enough so that lug 36 may clear indexing plateau 44 as it is lowered; and (2) it is preferred to have a slope sufficient to cause the lug and its associated string of pipe to rotate as the lug is lowered.

As mentioned above, there is a plurality of circumferentially spaced indexing and load-bearing plateaus 40 having load-bearing surfaces 50. It is important that load-bearing surfaces 50 be at the same longitudinal position of pipe 14A as each of the other circumferentially spaced plateaus. We accomplish that by cutting them simultaneously with a lathe to form a circumferential groove 51.

Figure 5:
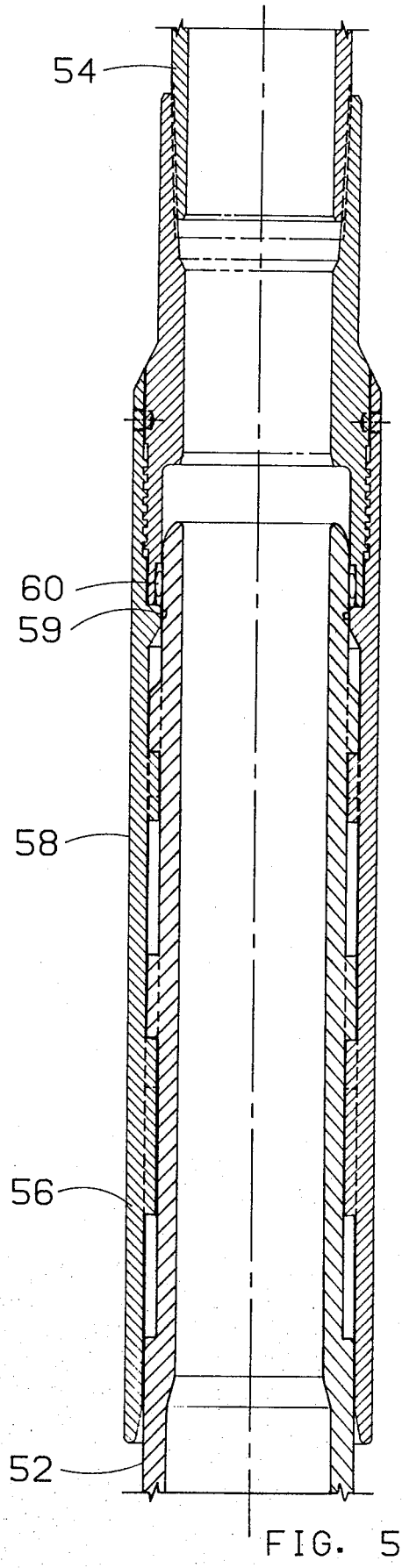
FIG. 5 is similar to FIG. 3 except FIG. 5 has multiple longitudinally spaced J-slots.

Attention is next directed to FIG. 5 which shows in vertical cross-section a "multiple J-slot" longitudinal arrangement. This concerns means for connecting a lower tubular member 52 to an upper tubular member 54. This illustrates a connecting means which, like the one illustrated in regard to FIG. 3, will provide a seal-tight connection and transmit tension. This includes a lower J-slot system 56 and an upper J-slot system 58. Seals 59 and 60 are also provided similarly as in the system of FIG. 3.

Figure 6:
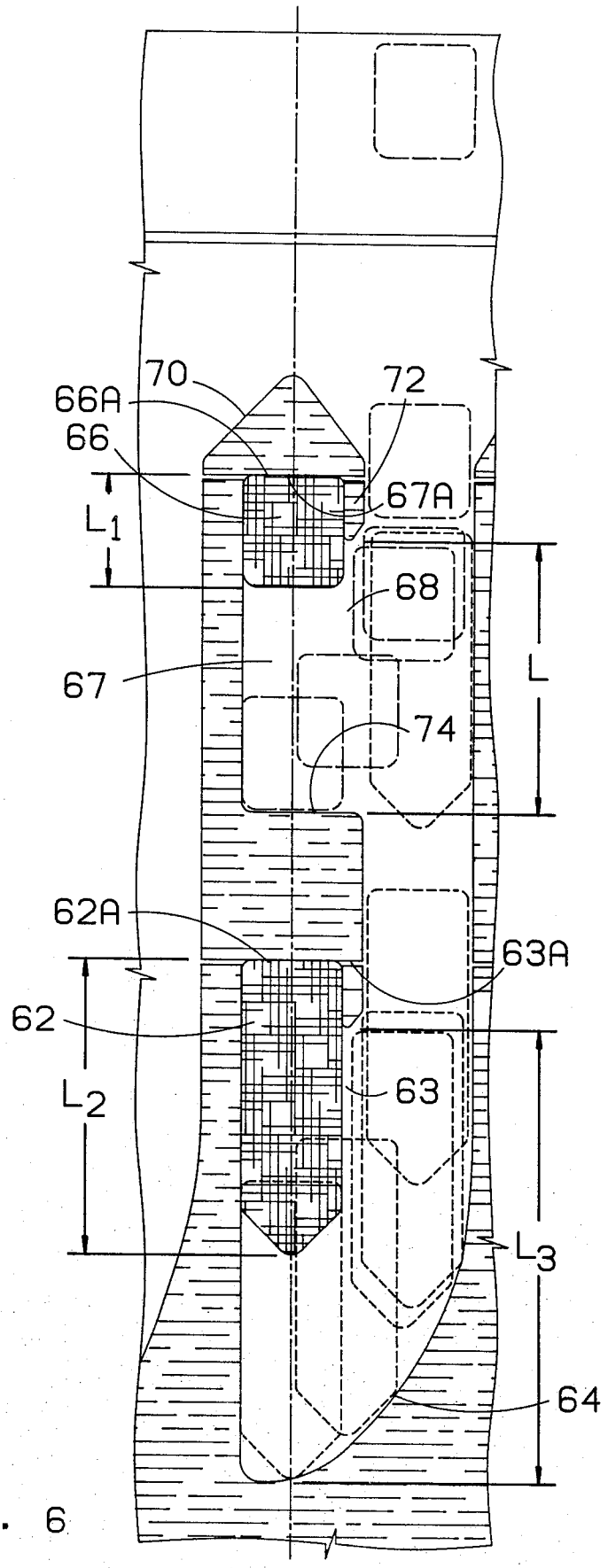
FIG. 6 illustrates the special J-slot assembly of FIG. 5.

Attention is next directed to FIG. 6 which illustrates the preferred embodiment of the multiple J-slot arrangement shown in FIG. 5. In FIG. 6, there is provided an upper lug 66 having an upper bearing surface 66A and a lower lug 62 having an upper bearing surface 62A which fit, respectively, into upper locking slot 67 having a downwardly facing bearing surface 67A and lower locking slot 63 having a downwardly facing bearing surface 63A. Upper locking slot 67 has a mouth 68 which has a vertical or longitudinal dimension L which is greater than $L_1$, the vertical dimension of upper lug 66, but less than the vertical dimension $L_2$ of the lower locking lug 62. The vertical dimension $L_2$ is less than the vertical dimension $L_3$ of the mouth of lower locking slot 63. With this relationship between the upper and lower lugs 66 and 62 and the opening 68 and the mouth of locking slot 63, it is impossible for the lower lug 62 to go into upper locking slot 67.

We will now briefly discuss how the proper distribution of loading between upper lug 66 and lower lug 62 is obtained. The J-slot 63 and lug 62 form a first load-carrying engagement A and J-slot 67 and lug 66 form a second load-carrying engagement B. That part of the tubular member (having the J-slots) between the load-bearing surfaces of the J-slots can be identified as the J-slot segment. The multiple J-slot design is required when the tensile loads cannot safely be transmitted through a single J-slot connector fitting in the radial clearance. The proper distribution of the loads transferred at the different stages is thus imperative. This is accomplished by adjusting the relative axial flexibility of the two pipes or tubular members between the bearing surfaces of the longitudinally spaced J-slots 63 and 67. The clearance or difference between the axial distances of the lug stages and bearing stages should be minimum. For example, in the case where only two stages are used, and load-carrying engagements A and B are each to have the same load-carrying capability, the axial stiffness $K_L$ between the two bearing stages of the member having the lugs and the axial stiffness $K_J$ between the two bearing stages of the member having the J-slots should be equal, $K_L = K_J$. If the design load to be carried by load-carrying engagements A and B is respectively designated $F_A$ and $F_B$, and where A is closer than B to the end of the lug member, then the axial stiffness ratio of the two segments is:

$$K_J/K_L = F_A/F_B$$

In the case of three stages, the axial stiffness should be distributed as follows: $[(F_B+F_C)/F_A]K_{L1}=K_{J2}$; $K_{L2}=[(F_A+F_B)/F_C]K_{J1}$ where $F_A$=design load carried by engagement "A" formed by first lug and third J-slot;

$F_B$=design load carried by engagement "B" formed by second lug and second J-slot;

$F_C$=design load carried by engagement "C" formed by third lug and first J-slot;

$K_{L1}$=axial stiffness of the lug member between the middle lug and the lug stage closest to the end of the member;

$K_{L2}$=axial stiffness of the lug member between the middle lug stage and the lug stage farthest away from the lug member;

$K_{J1}$=axial stiffness of the J-slot member between the middle bearing stage and the stage closest to the end of the J-slot member; and $K_{J2}$=axial stiffness of the J-slot member between the middle bearing stage and the stage farthest from the end of the J-slot member.

Figure 7:
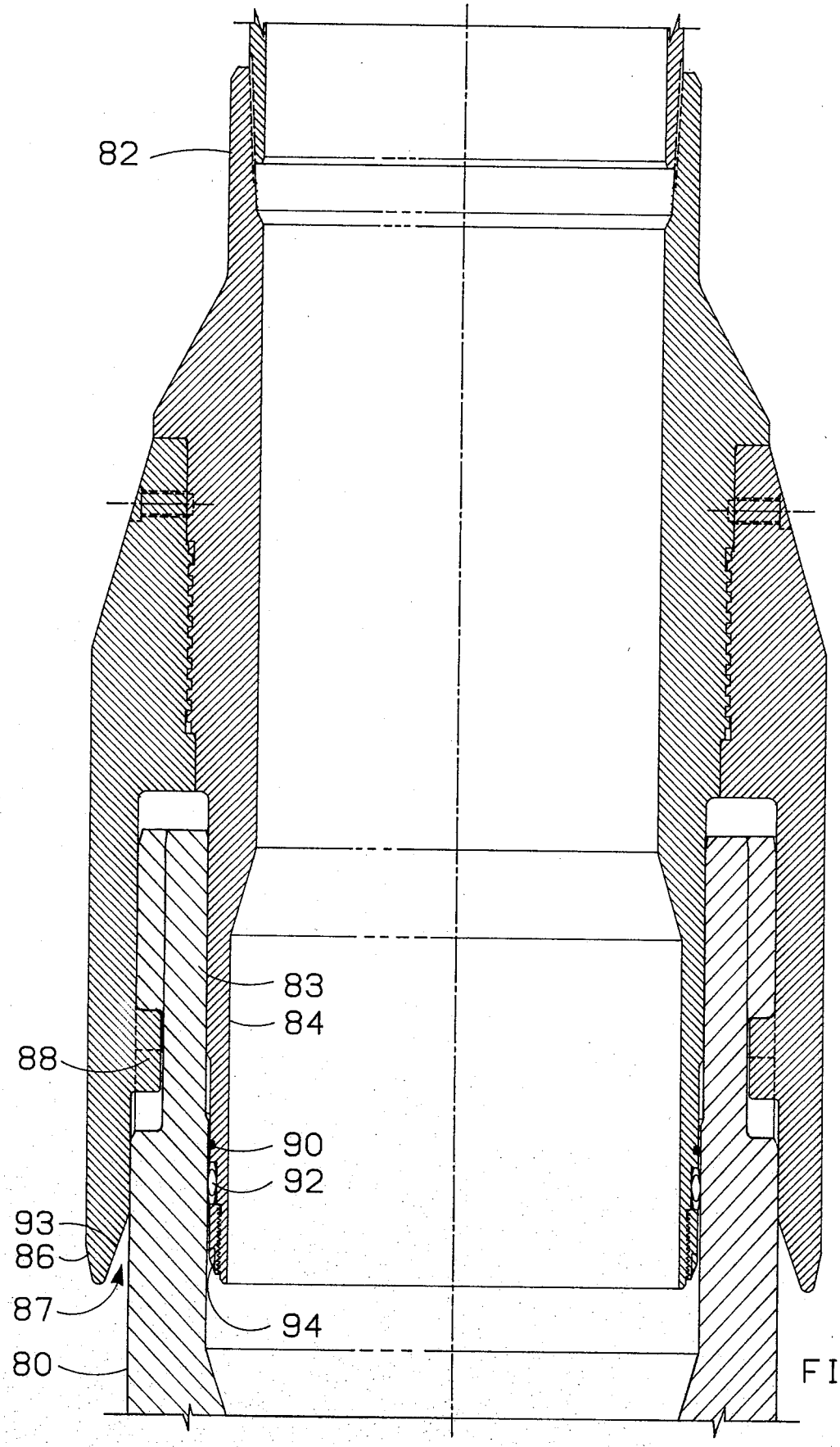
FIG. 7 illustrates in cross-section a modification of the connector shown in FIG. 3.

Attention is next directed to FIG. 7 which shows a modification of the J-slot connection described above in relation to FIGS. 3 and 4. This likewise has a means for connecting in a sealing relationship a lower tubular member 80 to an upper tubular member 82. The upper tubular member 82 has a connecting unit including an outer cylindrical member 86 and an inner concentric cylindrical member 84. This forms an annulus 87 into which an upper male extension 83 can extend. There is shown a J-slot connection means 88 between male extension 83 and outer member 86 which is very similar to that shown in FIG. 3, for example; however, the sealing means are located differently and are in a protected position. There is shown an O-ring seal 90 and sealing means 92 which can be self-energizing. Seals 90 and 92 are carried by extension 84. As the tool is lowered to mate with fixed member 80, these seals are in a protected position. The lower ends 94 and 93 of members 84 and 86, respectively, are flared to make the operation of stabbing over member 83 of lower conduit 80 easier. Here again, at seal 92, the wall thickness of member 84 is much less than the wall thickness of member 83, the unequal radial expansion force thus energizing seal 92.

Figure 8:
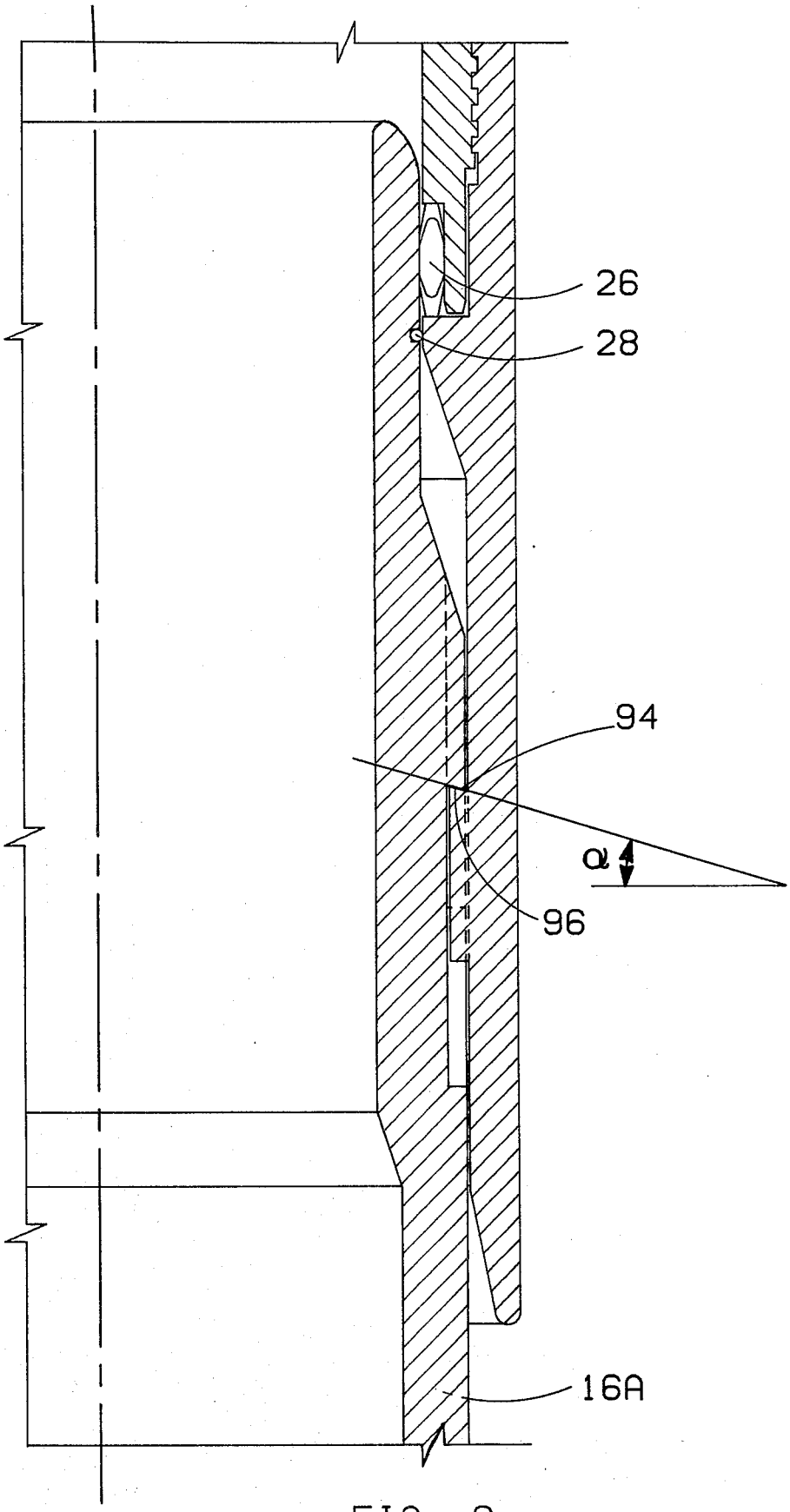
FIG. 8 illustrates a sloping surface connection between the top of the J-lug and the lower side of the J-slot.

Attention is next directed to FIG. 8 which illustrates a refinement on the relationship between the upper surface of the locking lug and the lower holding or load-bearing surface of the J-slot. Shown therein is an upper surface 94 of the lug which makes an angle $\alpha$ with a plane perpendicular to the tubular member on which lug is placed. The lower surface 96 of the J-slot which engages surface 94 has an angle so that the surface 96 mates with surface 94. A suitable or preferred angle $\alpha$ is between about 20 and 0 degrees. A preferred angle is 15 degrees. This tends to prohibit the pulling apart of the lugged member and the J-slotted member. The contact force between the lugs and the plateaus generate bending moments in the wall of the two pipes which tend to separate the lugs from the plateaus by inclining the contact surfaces between the lugs and the plateau. A radial component of the contact force is generated which brings the lugs and the plateaus together. An auto-locking effect is created.

Figure 9:
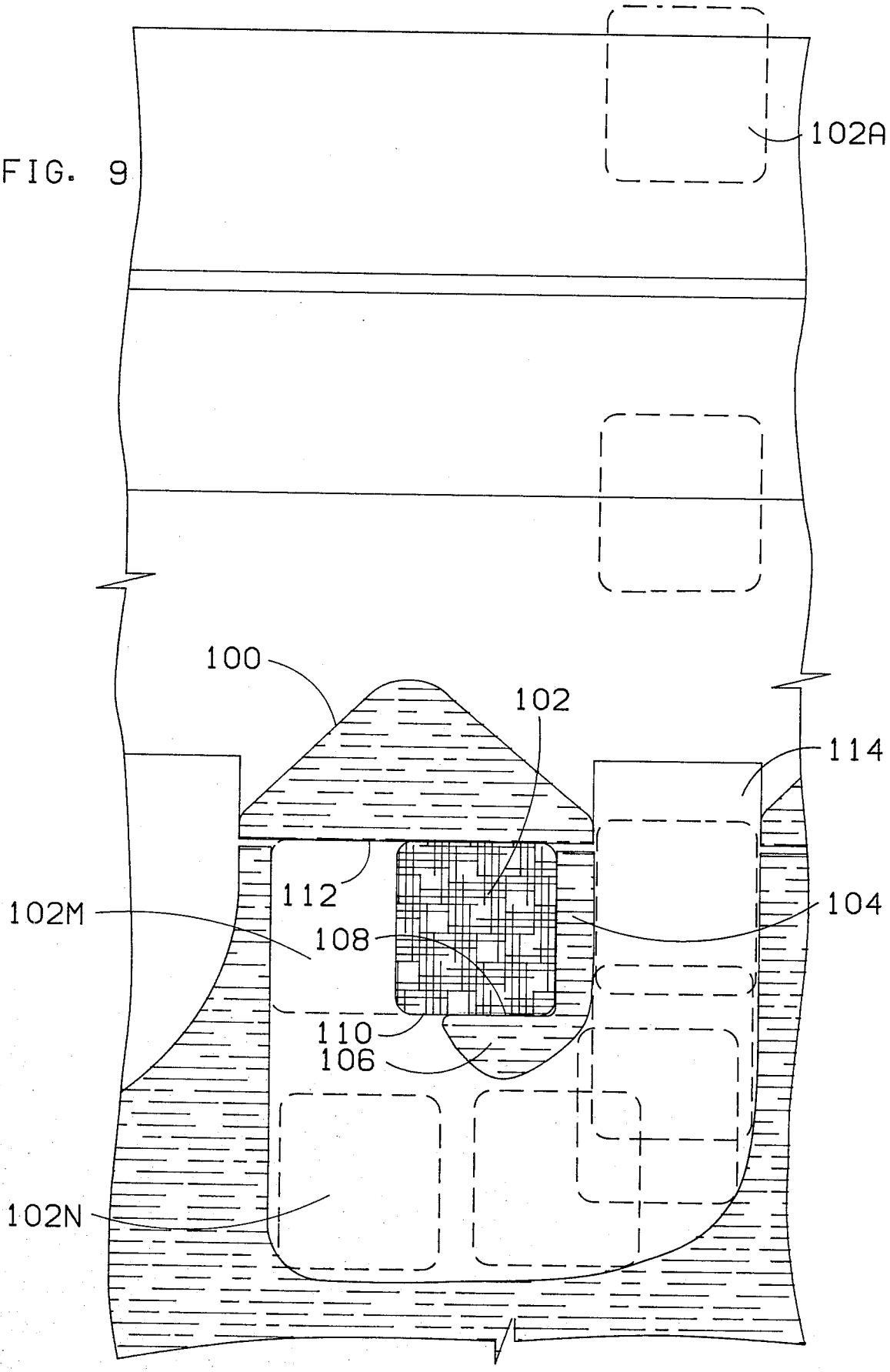
FIG. 9 is a modification of the embodiment of FIG. 4 to provide means in the J-slot connector for transmitting a compressive force.

In most of the contemplated uses of the J-slot connection described in this specification, the upper section of pipe such as section 54 of FIG. 5 will be in tension; however, there may be some situations where the upper section of pipe will be under compression. A modification of the J-slot connector which will take care of this compressive force is shown in FIG. 9. The main difference between this J-slot connector and those of the other figures is in the modification of the indexing plateau 104. Indexing plateau 104 has been modified to have horizontal extension or leg 106 which has an upper facing bearing surface 108. This is designed to mate with a portion of the downwardly facing bearing surface 110 of lug 102. Lug 102 has a vertical dimension so it can be rotated into the vertical space between leg 106 and the lower surface 112 of indexing and load-bearing plateau 100. In operation, the upper string of pipe supporting lug 102 is lowered from an upper position such as 102A downwardly. Indexing and load-bearing plateau 100 causes the pipe to rotate so that the lug 102 is in the vertical passage 114 of the J-slot. Continual lowering of the upper pipe results in the lug eventually reaching the position 102N. Thus far, the operation is similar to that shown in FIG. 4. When the lug is in position 102N, tension is applied to the upper string of pipe to pull the pipe upward where the lug reaches the position 102M. At this point, proper torque is applied to the pipe supporting lug 102 to move it into the position shown in FIG. 9. If desired, a slight torque may be left on the upper section of the pipe to assure that the lug 102 is maintained in the position shown in FIG. 9. If tension is ever lost on the upper string of pipe, the bearing surface 108 of leg 106 of indexing plateau 104 will resist downward movement.

While the above embodiments have been described in great detail, it is possible to incorporate variations therein without departing from the spirit or scope of the invention.

What is claimed is:

1. A tieback tool with self-energizing seal for sealingly securing a first tubular member suspended from a vessel floating on a body of water to a casing hung in a wellbore in the bottom of the body of water comprising:

a male tubular member having a J-slot on its exterior and a neck having a wall thickness $t_1$ and an outer cylindrical surface;

a female tubular member adapted to fit over said male tubular member and having a lug on the interior thereof insertable into said J-slot to prevent relative longitudinal movement of said members, said female tubular member having a section overlying the neck of said tubular member with a wall thickness of $t_2$ which is greater than $t_1$, the inner surface of said neck of said male tubular member being free of contact with said section of said female tubular member; and a seal sealingly engaging the outer cylindrical surface of said neck of said male tubular member and said section of said female tubular member the thickness $t_1$ to extend from terminal end of said neck to beyond said seal whereby for a given internal pressure said neck of said male tubular member expands radially more than said section of said female tubular member.

2. A tool as defined in claim 1 in which said J-slot includes:

a longitudinal passage;

an indexing and load-bearing plateau having an indexing race sloping toward said longitudinal passage;

a guiding race at the lower end of said passage having a slope other than zero with respect to the longitudinal axis of said female tubular member;

a locking slot beneath said indexing and load-bearing plateau; and an indexing plateau beneath a portion of said indexing and load-bearing plateau and adjacent said locking slot.

3. A tool as defined in claim 2 including a plurality of circumferentially spaced J-slots and a circumferential groove beneath said indexing and load-bearing plateaus.

4. A tieback tool for securing a first tubular member suspended from a vessel floating on a body of water to a casing hung in a wellbore in the bottom of the body of water comprising:

a male tubular member having a J-slot arrangement on its exterior comprising:

an upper indexing and load-bearing plateau having an indexing race thereon;

a lower load-bearing plateau;

a vertical passage extending adjacent to said upper load-bearing plateau and said lower load-bearing plateau;

an upper locking slot beneath said upper load-bearing plateau having a mouth opening into said vertical passage, the longitudinal dimension of said mouth being L; and a lower locking slot beneath said lower load-bearing plateau and having a mouth having a longitudinal dimension $L_3$ opening into said vertical passage; and a female tubular member adapted to fit over said male tubular member and having an upper lug adapted to fit into said upper locking slot and having a longitudinal dimension $L_1$ and a lower lug adapted to fit into said lower locking slot and having a longitudinal dimension $L_2$, said lower lug having a stabbing surface at the lower end thereof;

$L_1$ is less than $L_2$; and $L_2$ is greater than L but less than $L_3$ and $L_1$ is less than L.

5. A tool as defined in claim 4 in which the lower end of said passage has a slope other than zero with respect to the longitudinal dimension of said slot between said upper and lower locking slots.

6. The tool of claim 4 in which the axial stiffness $K_L$ of the female member between the two lugs is equal to the axial stiffness $K_B$ of the male member between the two load-bearing plateaus.

7. A tieback tool for sealingly securing a first tubular member suspended from a vessel floating on a body of water to a casing hung in the wellbore in the bottom of the body of water comprising:

a male tubular member with a neck having a wall thickness of $t_1$ and having an outer cylindrical surface;

a female tubular member adapted to fit over the neck of said male tubular member and having a section having a wall thickness $t_2$ which is greater than $t_1$ and has substantially less radial expansion than said neck for a given internal pressure, the inner surface of said neck male tubular member being free of contact with said section of said female tubular member;

a J-slot on either the interior of said female member or the exterior of said male member and a lug on the member not having the J-slot for insertion into said J-slot to form a latching mechanism; and a seal placed near the end of said neck of said male member and sealingly engaging the outer cylindrical surface of said neck of said male tubular member and said section of said female tubular member;

the thickness $t_1$ to extend from the terminal end of said neck to beyond said seal whereby for a given internal pressure said neck of said male tubular member expands radially more than said section of said female tubular member.

8. A tieback tool with a self-energizing seal for sealingly securing a first tubular member suspended from a floating vessel on a body of water to a casing hung in a wellbore in the bottom of the body of water comprising:

a male tubular member having a neck having a wall thickness of $t_1$ and an outer cylindrical surface and an inner cylindrical surface;

a female tubular member having an outer shell fitting over said neck of said male member and an inner circumferential shell having an outer cylindrical surface together forming an annulus into which said male member can be inserted, the thickness $t_3$ of the wall of said inner shell is less than the thickness of the wall of said male member;

a J-slot on either the interior of the outer shell of said female member or the exterior of said male member and a lug on one of these members not showing the J-slot for insertion into said J-slot to form a latching mechanism;

a seal sealingly engaging said inner shell of said female member and the neck of said male member the thickness $t_3$ extending from the terminal of said inner circumferential shell to beyond said seal whereby for a given internal pressure said inner circumferential shell expands radially more than said neck of said male member.

9. An apparatus as defined in either claims 1, 3, or 7 in which said lug has an upper plane surface when said female tubular member is inserted into a well and which has a slope $\alpha$ with respect to a horizontal plane perpendicular to the longitudinal axis of said female and male members and a mating surface on said J-slot, said angle $\alpha$ preferably between about 0 and 20 degrees.

10. A tool for securing a first tubular member to a second tubular member comprising:

a male tubular member;

a female tubular member adapted to fit over said male tubular member;

a first J-slot (67) and a second J-slot (63) both on either the interior of said female tubular member or on the exterior of said male tubular member, said J-slots being longitudinally spaced apart along such tubular member, said first J-slot being nearest the end of such tubular member;

a first lug (63) and a second lug (66) on the tubular member not having the J-slots, said lugs being spaced apart longitudinally along such tubular member, the longitudinal distance between the bearing surfaces of said J-slots and the longitudinal distance between the bearing surfaces of said J-slots and the longitudinal distance between the bearing surfaces of said lugs being about equal, said first lug being nearest the end of J-slot member; and said first lug and said second J-slot when engaged forming a load-carrying engagement A and said second lug and said first J-slot when engaged forming a load-carrying engagement B, the design load carried by A and by B, respectively, designated $F_A$ and $F_B$, and in which $$K_J/K_L=F_A/F_B$$

where $K_L$=axial stiffness of said tubular member having said lugs and between the lug-bearing surfaces; and $K_J$=axial stiffness of said tubular member having said J-slot and between the J-slot bearing surfaces and the two tubular members designed so that $K_L=K_J$.

11. A tool for securing a first tubular member to a second tubular member comprising:

a male tubular member;

a female tubular member adapted to fit over said male tubular member;

a first J-slot, a middle J-slot, and a third J-slot farthest from the end of the members on either the interior of said female tubular member or the exterior of said male tubular member, said slots being longitudinally spaced apart and longitudinally spaced apart first lug, second lug, and third lug on the member not having the J-slots, first lug being the one closest to the lug member end, said lugs adapted to engage said J-slots, the longitudinal distance between the bearing surfaces of said lugs and the corresponding longitudinal distance between the J-slot bearing surface being about equal and in which $$[(F_B+F_C)/F_A]K_{L1}=K_{J2}, \text{ and}$$

$$K_{L2}=[(F_A+F_B)/F_C]K_{J1}$$

where $F_A$=design load carried by engagement "A" formed when first lug and third J-slot are engaged $F_B$=design load carried by engagement "B" formed when said second lug and said second J-slot are engaged $F_C$=design load carried by engagement "C" formed when said third lug and said first J-slot are engaged $K_{L1}$=axial stiffness of the tubular member having said lugs and between the first lug and the second lug stage;

$K_{L2}$=axial stiffness of the tubular member having said lugs and between the second lug stage and the third lug stage;

$K_{J1}$=axial stiffness of the tubular member having said J-slots and between the first J-slot bearing surface and the second J-slot bearing surface; and $K_{J2}$=axial stiffness of the tubular member having said J-slots and between the bearing surface of the second J-slot and the bearing surface of the third J-slot.

* * * * *